US006470703B2

(12) United States Patent
Wada et al.

(10) Patent No.: US 6,470,703 B2
(45) Date of Patent: Oct. 29, 2002

(54) SUBCOOLING-TYPE CONDENSER

(75) Inventors: Kenichi Wada, Honjo; Hirotaka Kado, Isesaki; Toshiharu Shimmura, Sawa-gun, all of (JP)

(73) Assignee: Sanden Corporation, Gunma (JP)

( * ) Notice: Subject to any disclaimer, the term of this patent is extended or adjusted under 35 U.S.C. 154(b) by 40 days.

(21) Appl. No.: 09/843,926

(22) Filed: Apr. 30, 2001

(65) Prior Publication Data

US 2001/0039809 A1 Nov. 15, 2001

(30) Foreign Application Priority Data

May 9, 2000 (JP) ..... 2000-135415
Apr. 13, 2001 (JP) ..... 2001-115155

(51) Int. Cl.[7] ..... F25B 39/04
(52) U.S. Cl. ..... 62/509; 62/515; 165/110
(58) Field of Search ..... 62/505, 506, 507, 62/515, 509; 165/110, 144, 174

(56) References Cited

U.S. PATENT DOCUMENTS 4,972,683 A * 11/1990 Beatenbough ..... 62/507
2,086,835 A 2/1992 Shinmura
5,101,890 A 4/1992 Aoki et al.
5,172,758 A * 12/1992 Aoki ..... 165/110
5,176,200 A 1/1993 Shinmura
5,690,166 A 11/1997 Yamaguchi
5,752,566 A * 5/1998 Liu et al. ..... 165/110
5,988,267 A * 11/1999 Park et al. ..... 165/110

FOREIGN PATENT DOCUMENTS

JP 05010633 1/1993
JP 5-39969 A * 2/1993 ..... 165/110

* cited by examiner

*Primary Examiner*—Denise L. Esquivel
*Assistant Examiner*—Melvin Jones
(74) *Attorney, Agent, or Firm*—Baker Botts L.L.P.

(57) ABSTRACT

A subcooling-type condenser includes a refrigerant condensation core and a subcooling core for supercooling refrigerant condensed by the refrigerant condensation core. A header portion corresponding to an entrance portion of the subcooling core is formed as a liquid refrigerant storage portion, and a capacity of the header Vh is set within a range of 100 cc≦Vh≦250 cc. Thus, subcooling-type condenser having a desired re-liquefaction function without using a separately formed liquid tank may be achieved, thereby reducing the condenser's size and cost.

9 Claims, 10 Drawing Sheets

SUBCOOLING-TYPE CONDENSER

BACKGROUND OF THE INTENTION

1. Field of the Invention

The present invention relates to a subcooling-type condenser, and, more specifically, to a subcooling-type condenser, the header of which functions as a liquid tank.

2. Description of Related Art

In a refrigerating cycle, refrigerant compressed by a compressor usually is sent to a condenser. After the refrigerant is condensed by the condenser, the condensed refrigerant is sent to an evaporator through an expansion valve via a receiver tank, and after the cooling function is achieved at the evaporator by heat exchange between the refrigerant and an outside fluid, the refrigerant from the evaporator is sent to the compressor to again be compressed. In such a receiver cycle (i.e., a cycle having a condenser plus a receiver), vaporized refrigerant is not completely (i.e., 100%) re-liquefied, and a portion of the vaporized refrigerant remains as gas and the refrigerant is returned to the evaporator in this partially re-liquefied condition. Because a portion of the refrigerant remains vaporized, the cooling ability of the refrigerating cycle is limited.

In comparison with the above-described receiver cycle, recently a subcooling-type condenser has received attention. In a subcooling-type condenser, a heat exchange region of the whole of a core of a heat exchanger is divided into a refrigerant condensation core region, and a subcooling-core region for supercooling refrigerant condensed in the refrigerant condensation core region. In the subcooling core region, the remaining vaporized refrigerant is almost entirely re-liquefied, i.e., about 100%, by supercooling.

In such known subcooling-type condensers, a liquid tank is provided separate from a header of the heat exchanger. Usually, refrigerant from the refrigerant condensation core is stored in the liquid tank, and then the refrigerant is sent to the subcooling core.

However, in such a structure wherein the separate liquid tank is attached, the size of the entire subcooling-type condenser may be increased, and the number of parts and pipes may become large, thereby complicating the structure of the condenser. Although a structure is proposed wherein a liquid tank is structured integrally with a header of a heat exchanger, the inside structure of the header also may become extremely complicated, and the cost for manufacture may increase.

Further, Japanese Patent Publication No. JP-A-5-10633 discloses a condenser wherein a gas-liquid separating portion is provided between a refrigerant condensation core and a subcooling core. In this structure, however, because the gas-liquid separating portion occupies a relatively large area, the core size of the condenser, and ultimately, the size of the entire condenser may increase. Moreover, the structure of such a condenser may become still more complicated.

SUMMARY OF THE INVENTION

Accordingly, a need has arisen to provide a subcooling-type condenser having a desired re-liquefaction function, wherein a separately formed liquid tank is unnecessary. The condenser provides a liquid storing function in a header itself, which header has a simplified structure. This structure may reduce the size and cost of the whole of a condenser.

To achieve the foregoing and other objects, a subcooling-type condenser according to the present invention is herein provided. The subcooling-type condenser comprises a pair of headers, and a plurality of heat transfer tubes interconnecting the pair of headers and extending in parallel to each other. The condenser is divided into a refrigerant condensation core for condensing refrigerant and a subcooling core for supercooling refrigerant condensed by the refrigerant condensation core. A second header forming a header portion corresponding to an entrance portion of the subcooling core is formed integrally with a header portion for the refrigerant condensation core and a header portion for the subcooling core. At least the header portion corresponding to the entrance portion of the subcooling core is formed as a liquid refrigerant storage portion. A capacity of the second header Vh is set within a range of 100 cc$\leqq$Vh$\leqq$250 cc. Preferably, the capacity of the second header Vh is set within a range of 150 cc$\leqq$Vh$\leqq$200 cc.

The capacity of the second header Vh is set within a range, such that the compressor achieves an optimum width of a plateau region in a characteristic graph indicating a relationship between a degree of supercooling in a portion of the subcooling core and an amount of refrigerant enclosed in the subcooling-type condenser. The "plateau region" refers to a region within which even if an amount of enclosed refrigerant (e.g., an amount of refrigerant present in a subcooling-type condenser) varies, the degree of supercooling in the subcooling core portion may be within a specified, relatively small range, for example, ±1° C. In particular, the plateau region is a region, within which even if the amount of enclosed refrigerant increases or decreases, the respective portions in the subcooling-type condenser are substantially unaffected by varying conditions such as a high pressure. Consequently, a stable cooling operation is maintained. In the present invention, an optimum range of the width of this plateau region has been determined. In order to obtain this optimum range, the capacity of the second header having a liquid refrigerant storing function is set to the specified ranges described above. These ranges may correspond to the optimum ranges. The basis for determining the values for the upper and lower limits of these optimum ranges of plateau region is clarified by the explanation of the experimental results described below. Thus, in the present invention, an optimum liquid refrigerant storing function is given to the second header of the subcooling-type condenser, and the capacity of the second header is selected within the above-described optimum range.

Further, in the subcooling-type condenser according to the present invention, it is preferred that a capacity of at least the header portion corresponding to the entrance portion of the subcooling core in the second header is greater than a capacity of a header portion corresponding to an exit portion of the subcooling core in a first header. Particularly, it is preferred that the capacity of at least the header portion corresponding to the entrance portion of the subcooling core in the second header is within a range of about two times to about three times the capacity of the header portion corresponding to the exit portion of the subcooling core in the first header.

The second header may be formed, so that the cross-sectional area of the header portion for the refrigerant condensation core is substantially the same as the cross-sectional area of the header portion for the subcooling core.

The first header may be formed integrally with a header portion of the refrigerant condensation core and a header portion for the subcooling core. The refrigerant condensation core and the subcooling core may be separated by dividing the first header. In particular, the refrigerant condensation core and the subcooling core may be separated by providing a partition within the first header.

Further, in the subcooling-type condenser according to the present invention, a refrigerant passage comprising the plurality of heat transfer tubes in the refrigerant condensation core is formed preferably as a one-way path. In particular, refrigerant having passed through the refrigerant condensation core, which is formed as a one-way refrigerant path, is introduced into the subcooling core through the liquid refrigerant storage portion. The structure of the entire subcooling-type condenser may be simplified, and the condenser may be reduced in size, by forming the refrigerant path of the refrigerant condensation core as a one-way path. In the present invention, however, the refrigerant path of the refrigerant condensation core also may be formed as a two-way path.

Further, the subcooling-type condenser according to the present invention may be constructed, so that the pair of headers extend in a first or vertical direction, and the plurality of heat transfer tubes extend in a second or horizontal direction. The second header of the pair of headers also may be formed, such that the header portion of the refrigerant condensation core and the header portion of the subcooling core are integrally formed, and at least the header portion corresponding to the entrance portion of the subcooling core may be formed as a liquid refrigerant storage portion.

In the subcooling-type condenser according to the present invention, the liquid refrigerant storage portion is formed directly in the second header without providing a separate liquid tank, and refrigerant having passed through the refrigerant condensation core is introduced directly into the subcooling core through the second header. If the capacity of the header portion corresponding to the entrance portion of the subcooling core is greater than the capacity of the header portion corresponding to the exit portion of the subcooling core in the first header, and a liquid refrigerant storage portion having an adequate capacity is formed in the second header, the re-liquefaction of refrigerant may be accelerated without causing inconvenience, and the refrigerant may achieve substantially complete, i.e., about 100%, re-liquefaction.

Specifically, because substantially the same properties as those of a conventional liquid tank may be provided to the second header itself and because a part of the second header is formed as a liquid refrigerant storage portion, a desired re-liquefaction function may be achieved without substantially increasing the number of condenser parts. Consequently, the structure of the subcooling-type condenser may be simplified, the size of the entire condenser may readily be decreased, and the cost for manufacture may be reduced.

Moreover, in the present invention, because the capacity of the second header is selected within an optimum range, so that an optimum width of the plateau region may be achieved, a desired function for supercooling may be stably exhibited, and an efficient and stable operation may be achieved even for the cooling system as a whole.

Thus, according to the subcooling-type condenser of the present invention, refrigerant may be adequately re-liquefied in the subcooling core by forming a liquid refrigerant storage portion by the second header itself without providing a separate liquid tank. An optimum plateau region for stable operation of the condenser may be achieved by setting the capacity of the second header at an optimum capacity within a specified range. Therefore, a subcooling-type condenser having a simplified structure and desirable properties may be manufactured at a reduced cost, and the size of the entire condenser may readily be decreased.

Other objects, features, and advantages of the present invention will be understood from the following detailed description of preferred embodiments of the present invention with reference to the accompanying figures.

BRIEF DESCRIPTION OF THE DRAWINGS

Embodiments of the invention now are described with reference to the accompanying figures, which are given by way of example only, and are not intended to limit the present invention.

DETAILED DESCRIPTION OF PREFERRED EMBODIMENTS

Figure 1:
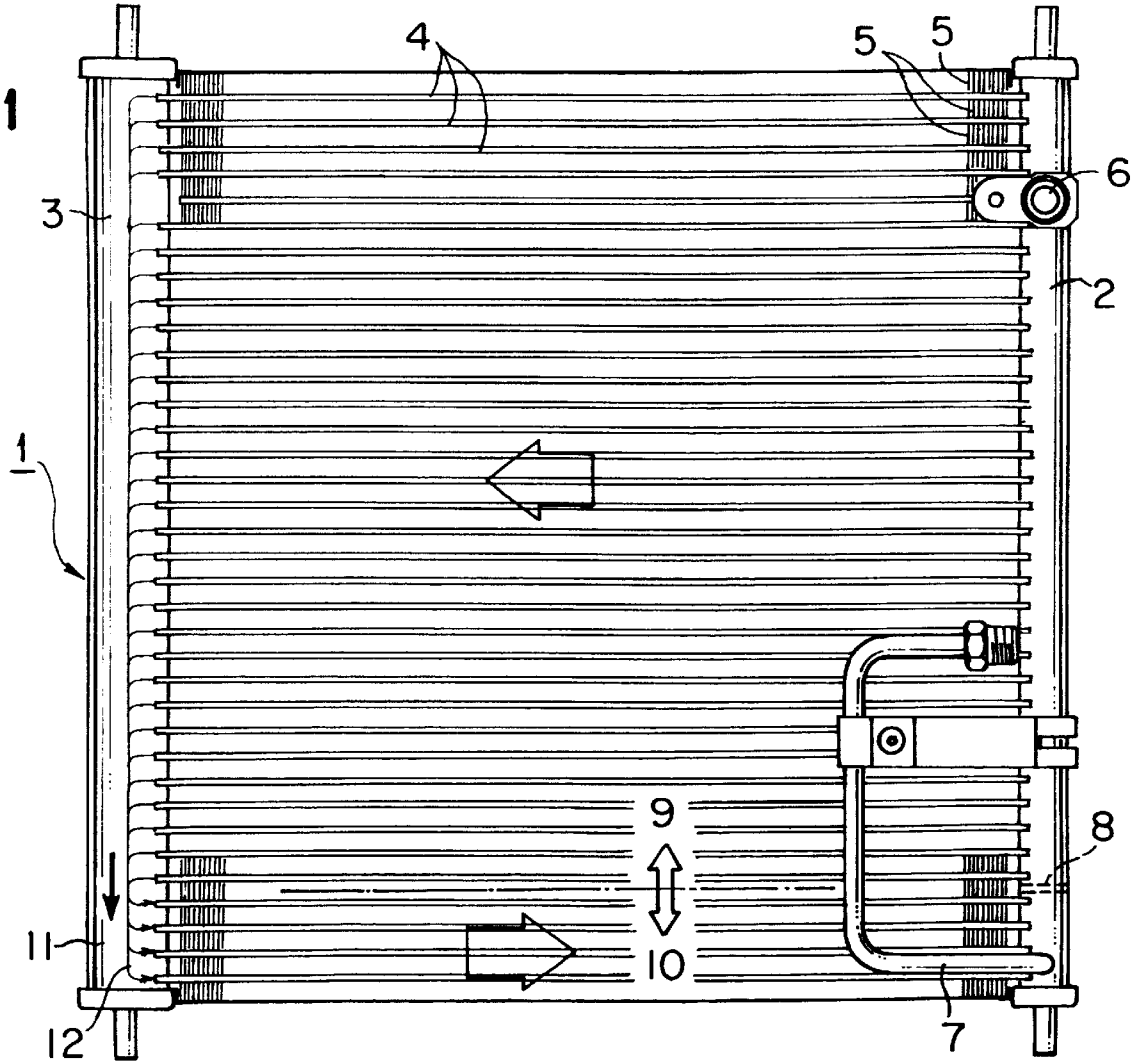
FIG. 1 is an elevational view of a subcooling-type condenser according to an embodiment of the present invention.
Figure 2:
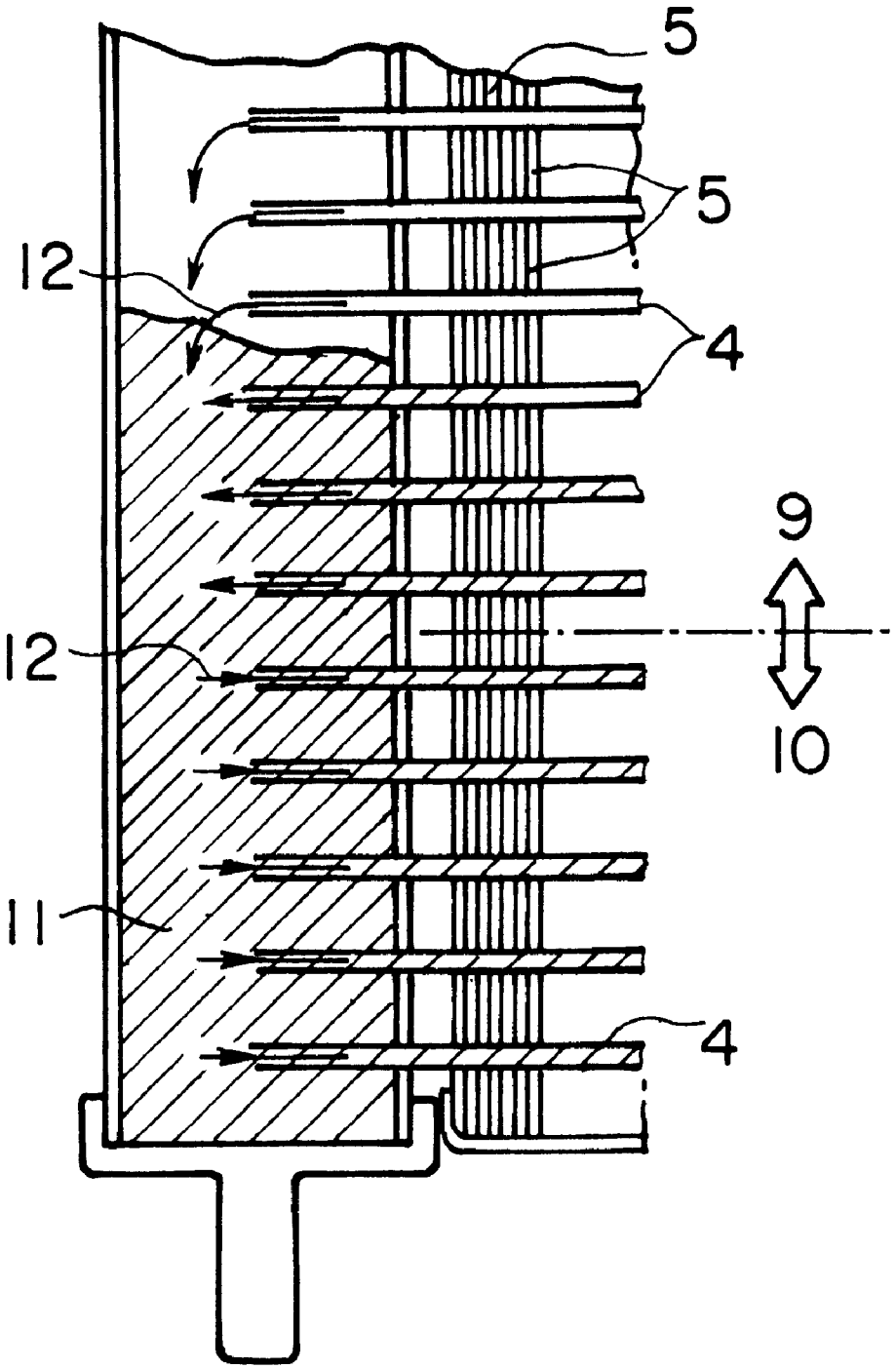
FIG. 2 is an enlarged, partial, vertical cross-sectional view of a the condenser depicted in FIG. 1.

Referring to FIGS. 1 and 2, a subcooling-type condenser according to an embodiment of the present invention is depicted. In FIG. 1, subcooling-type condenser 1 comprises a pair of headers 2, 3 disposed in parallel to each other. First header 2 and second header 3 each extend in a vertical direction. A plurality of heat transfer tubes 4 (e.g., flat-type refrigerant tubes) are disposed in parallel to each other with a predetermined interval. Tubes 4 fluidly interconnect the pair of headers 2, 3. Tubes 4 extend in a horizontal direction, i.e., at right angles to headers 2, 3. Corrugated fins 5 are interposed between the respective adjacent heat transfer tubes 4 and outside of the outermost heat transfer tubes 4 as outermost fins.

Inlet pipe 6 for introducing refrigerant into subcooling-type condenser 1 is provided on the upper portion of first header 2. Outlet pipe 7 for removing refrigerant from subcooling-type condenser 1 is provided on the lower portion of header 2. The inside of header 2 is divided into an upper space and a lower space by partition 8. By this partition 8, the area arranged with the plurality of heat transfer tubes 4 is divided into refrigerant condensation core 9 for condensing refrigerant introduced into condenser 1 and subcooling core 10 for supercooling refrigerant condensed by refrigerant condensation core 9. In particular, by providing partition 8 in integrally formed first header 2, the whole of the core of condenser 1 is divided into refrigerant condensation core 9 and subcooling core 10. In this embodiment, a refrigerant passage of refrigerant condensation core 9, which is formed by a plurality of parallel heat transfer tubes 4, is formed as a one-way path. Therefore, refrigerant introduced into first header 2 through inlet pipe 6 passes through the respective heat transfer tubes 4 of refrigerant condensation core 9 in a one-way path and flows into second header 3. After the refrigerant flows downwardly in second header 3, it is introduced directly into an entrance portion of subcooling core 10. The refrigerant passes through the respective heat transfer tubes 4 of subcooling core 10, and the refrigerant then is discharged from outlet pipe 7.

In this embodiment, a rate of refrigerant occupancy of the portion of subcooling core 10 relative to the entire area of the core portion of subcooling-type condenser 1 is set within a range of about 10% to about 12%. According to an experiment with the present invention, the rate of refrigerant occupancy preferably is within a range of about 5% to about 12%. By setting the occupancy rate within this range, an optimum degree of supercooling may be realized while suppressing increases in pressure on a high pressure side, that are caused by space limitations due to the installation of the condenser in an engine compartment of a vehicle. In particular, such pressure increases are suppressed by a structure for subcooling within a limited condenser size. Further, an optimum degree of supercooling may be realized while avoiding increases in fuel consumption of the vehicle accompanying increases on the high pressure side.

Further, in this embodiment, in second header 3, at least the header portion corresponding to the entrance portion of subcooling core 10 is formed as liquid refrigerant storage portion 11. As depicted in FIG. 2, refrigerant sent from refrigerant condensation core 9 is stored in this liquid refrigerant storage portion 11, and introduced therefrom into respective heat transfer tubes 4 of subcooling core 10. Arrows 12 in FIGS. 1 and 2 show this flow of refrigerant.

The capacity Vh of second header 3, forming liquid refrigerant storage portion 11 as described above, is chosen within a specified range as follows. In particular aforementioned, the capacity Vh of second header 3 is set within a range of 100 cc$\leqq$Vh$\leqq$250 cc in order to realize an optimum width of a plateau region. Preferably, Vh is chosen within a range of 150 cc$\leqq$Vh$\leqq$200 cc. Such a range of Vh for realizing an optimum width of a plateau region was selected based on desirable properties of subcooling-type condenser 1 targeted in the present invention and based on experimental results. The details of the basis for determining the above-described ranges and the results of experiments for determining ranges are described below.

Further, in this embodiment, the capacity of at least the header portion corresponding to the entrance portion of subcooling core 10 in second header 3 is greater than a capacity of a header portion corresponding to an exit portion of subcooling core 10 in first header 2. In particular, this capacity of at least the header portion corresponding to the entrance portion of subcooling core 10 in second header 3 is chosen in a range of about two times to about three times of the capacity of the header portion corresponding to the exit portion of subcooling core 10 in first header 2. By setting the capacity at a value more than two times the capacity of the header portion corresponding to the exit portion of subcooling core 10, excellent properties may be exhibited as shown in the results of experiments described below. If the capacity is chosen at a value more than about three times the capacity of the header portion corresponding to the exit portion of subcooling core 10, problems may arise with respect space required for installation of the condenser in an engine compartment of a vehicle and due to increases in the amount of enclosed refrigerant. Such conditions are not desirable.

The above-described preferable relationship between the capacity of at least the header portion corresponding to the entrance portion of subcooling core 10 in second header 3 and the capacity of the header portion corresponding to the exit portion of subcooling core 10 in first header 2 is achieved by selecting an inner diameter of second header 3 greater than an inner diameter of first header 2 in this embodiment. In particular, in this embodiment, first header 2 and second header 3 are formed, respectively, so that the cross-sectional area of a header portion for refrigerant condensation core 9 is substantially the same as the cross-sectional area of a header portion for subcooling core 10. Therefore, the preferred relationship, as described above, between the capacities may be achieved by setting the inner diameter of second header 3 greater than the inner diameter of first header 2 and by setting the respective absolute, inner diameters appropriately.

Further, in this embodiment, the following preferable structure is employed for the heat transfer tubes for refrigerant condensation core 9 or subcooling core 10, or both.

First, in refrigerant condensation core 9, a flow division parameter $\gamma$, which is defined as a ratio of a resistance parameter $\beta$ of tube 4 to a resistance parameter $\alpha$ of first header 2 that is an entrance-side header relative to tube 4 carrying refrigerant in a first direction (in the refrigerant flow direction in refrigerant condensation core 9), is selected at not less than 0.5, and, preferably, in a range of about 0.5 to about 1.5.

Where, $\gamma=\beta/\alpha$, $\beta=Lt/(Dt\cdot n)$, and $\alpha=Lh/Dh$; and where the equation variables are defined as follows:

Lt: length of tube,

Dt: hydraulic diameter of one tube, n: number of tubes carrying refrigerant in the first direction, Lh: length of the portion of refrigerant condensation core 9 in first header 2, and Dh: hydraulic diameter of first header 2.

When refrigerant condensation core 9 is thus constructed, the relationship between the pressure in header 2 and the pressure in heat transfer tube 4 (particularly, resistance of tube 4) may be adjusted to a desired relationship via the flow division parameter $\gamma$. By this adjustment, the flow resistance of the path of tube 4 appropriately increases, refrigerant may be prevented from passing in large and concentrated amounts into the tubes connected to header 2 at its refrigerant inlet portion having the highest pressure, and refrigerant may be retained more uniformly in header 2. As a result, the refrigerant pressure in header 2 may be made more uniform, the pressure applied to respective tubes 4 may be made more uniform to achieve a balanced flow division. Therefore, refrigerant having passed through refrigerant condensation core 9 is collected in second header 3 in a condition of balanced flow divisional, and the capacity (e.g., the cross-sectional area) of at least the header portion corresponding to the entrance portion of subcooling core 10 in second header 3 may be minimized. As a result, it becomes possible to minimize the amount of enclosed refrigerant as well as to reduce the size of entire subcooling-type condenser 1.

In order to set the above-described flow division parameters γ within the desired range, the pressure in the header and the resistance of the tubes must be in a predetermined relationship. It is particularly effective to design a structure in which the tubes have a relatively great resistance while refrigerant flows within the tubes, without generating a great temperature distribution. To make each tube have a relatively large resistance, it also is effective to use a tube structure dividing the interior of the tube into a plurality of short paths.

In order to set the flow division parameter γ within the target range desired in the present invention, it is possible to employ a structure in which the interior of the tube is divided merely into a plurality of straight paths, for example, a tube structure in which the plurality of short paths are formed, so that the short, straight paths extend separate from each other in the longitudinal direction of the tube. Such tubes may be manufactured by extrusion molding or injection molding. However, in order to further suppress the temperature difference in the tube, it is more preferable to use a tube structure in which a plurality of paths are formed in each heat transfer tube and the paths allow the heat exchange medium to flow substantially freely in the longitudinal and transverse directions of each tube. Such a plurality of paths may be formed by an inner fin or protruded portions provided on an inner surface of the tube.

Figure 3:
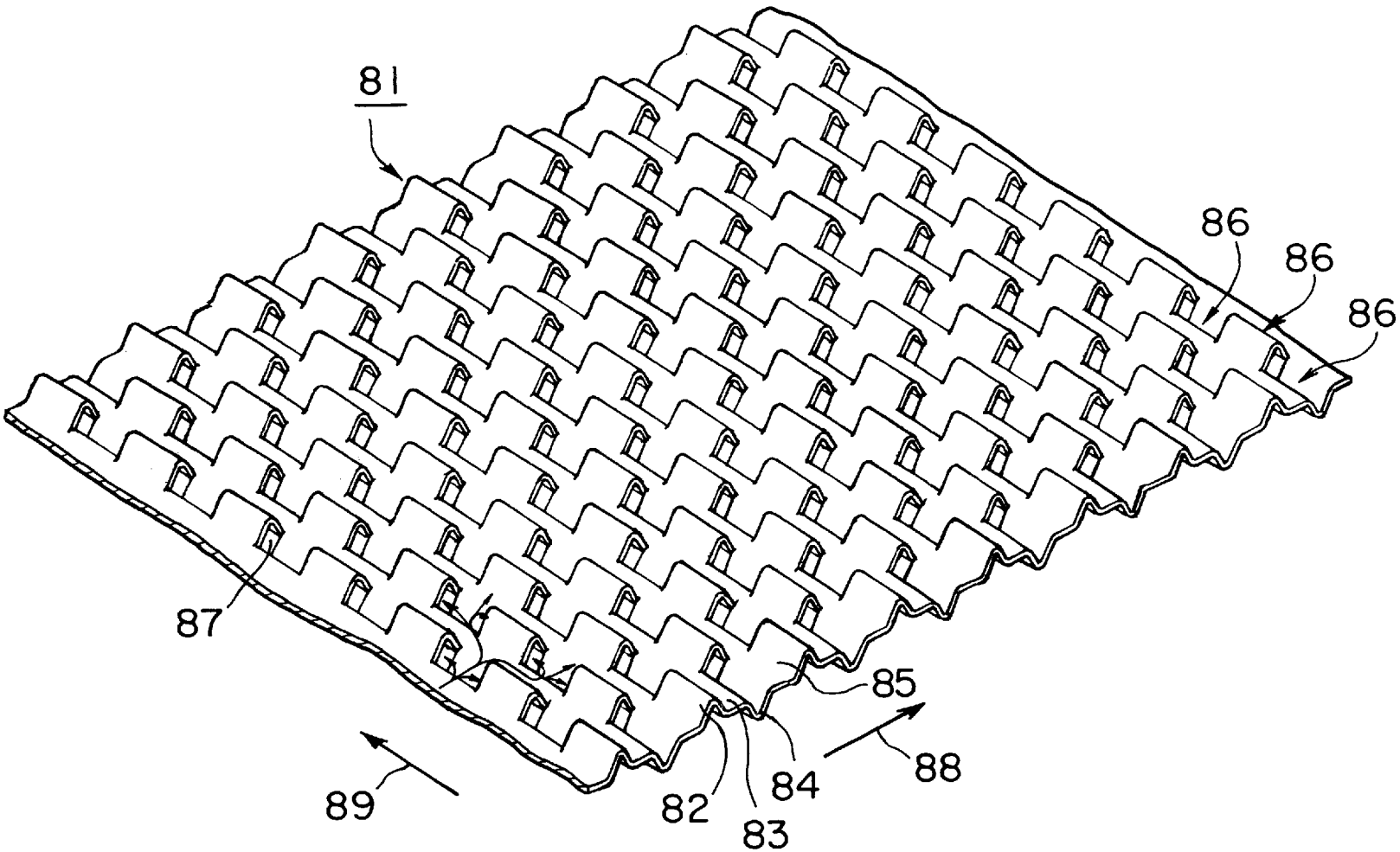
FIG. 3 is a partial, perspective view of an example of an inner fin such as that disposed within a heat transfer tube of the condenser depicted in FIG. 1.

The inner fin forming such a plurality of paths in a tube is formed, for example, as depicted in FIG. 3. In FIG. 3, inner fin 81 is formed, such that a plurality of raised portions and depressed portions are created in a flat plate by slotting and bending the flat plate. A plurality of waving strips 86, each having a raised portion 82, a first flat portion 83, a depressed portion 84, and a second flat portion 85 formed repeatedly in this order, are arranged adjacent to each other. First flat portion 83 of one waving strip and second flat portion 85 of an other waving strip adjacent to the one waving strip form a continuous flat portion. Refrigerant may flow freely through respective communication holes 87 formed by waving strips 86, thereby dividing the refrigerant flow appropriately. The refrigerant flow direction may be set in either first direction 88 or second direction 89.

Further, a plurality of flow paths in a tube also may be formed by protrusions provided on the inner surface of the tube. These protrusions may extend from the tube surface and meet or abut in the center of the tubes. In this case, the protrusions may be formed by embossing a wall of tube.

Figure 4:
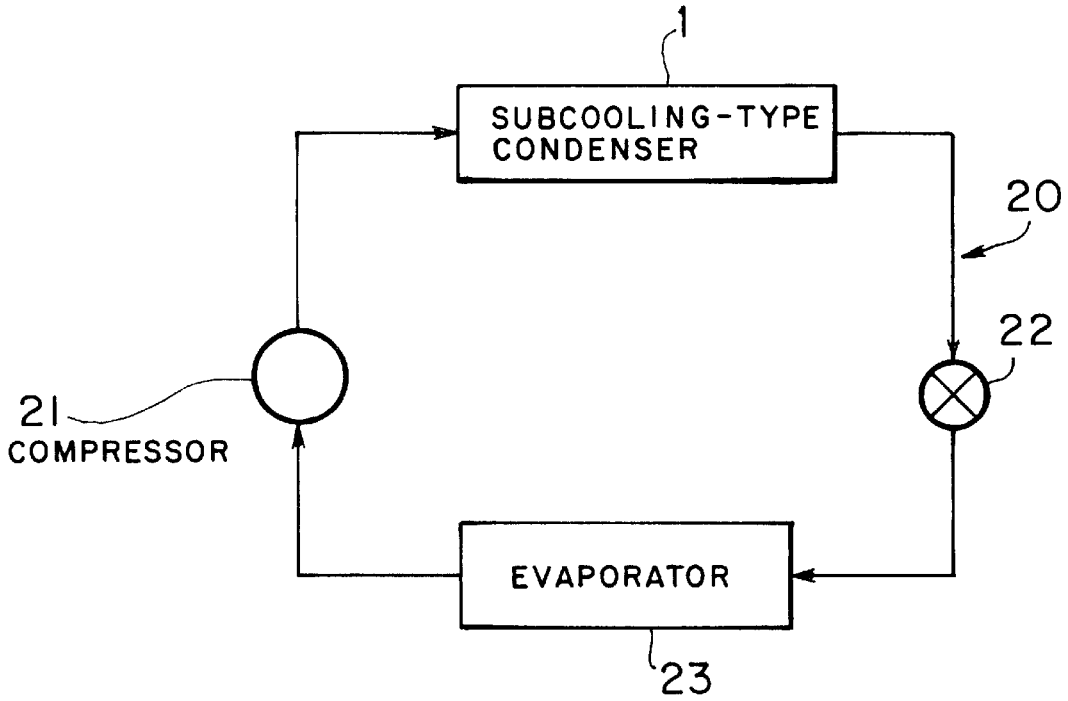
FIG. 4 is a schematic diagram showing an example of a refrigerating system incorporating the condenser depicted in FIG. 1.

The above-described subcooling-type condenser 1 is incorporated, for example, into refrigerating cycle 20 as depicted in FIG. 4.

In FIG. 4, refrigerant compressed by compressor 21 is sent to subcooling-type condenser 1. The refrigerant is condensed in condenser 1 and thereafter is supercooled and re-liquefied. The refrigerant then is sent to evaporator 23 through expansion valve 22. Cooling function is achieved by the heat absorption in evaporator 23. Ultimately, from evaporator 23 is sent to compressor 21 and compressed again.

Figure 5:
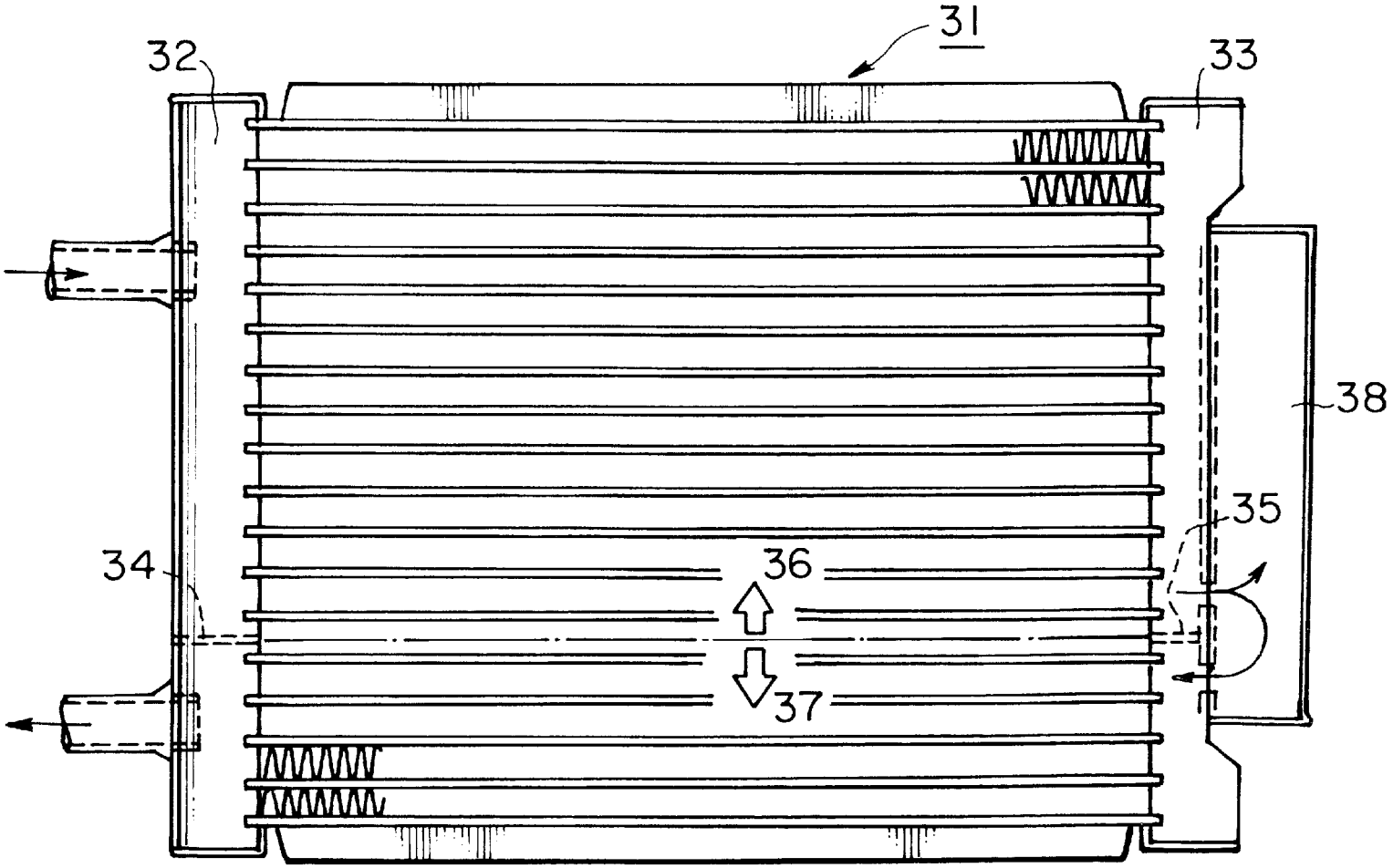
FIG. 5 is an elevational view of a known subcooling-type condenser used in a comparison experiment.

In order to examine the properties of subcooling-type condenser 1 depicted in FIGS. 1 and 2, a comparison experiment was performed with a known subcooling-type condenser 31 depicted in FIG. 5. In known subcooling-type condenser 31, the core portion is divided into refrigerant condensation core 36 and subcooling core 37 by providing partitions 34 and 35 in headers 32 and 33, respectively, and a liquid tank 38 is provided at a side portion of header 33. On the other hand, in subcooling-type condenser 1 according to the present invention, which was employed for the comparison experiment, the size of the entire core portion is set at the same size as that of known subcooling-type condenser 31, and the ratio of the capacity of second header 3 to the capacity of first header 2 is set at about 2.32:1. Further, inner fins 81, as depicted in FIG. 3, are disposed in heat transfer tubes 4.

Figure 6:
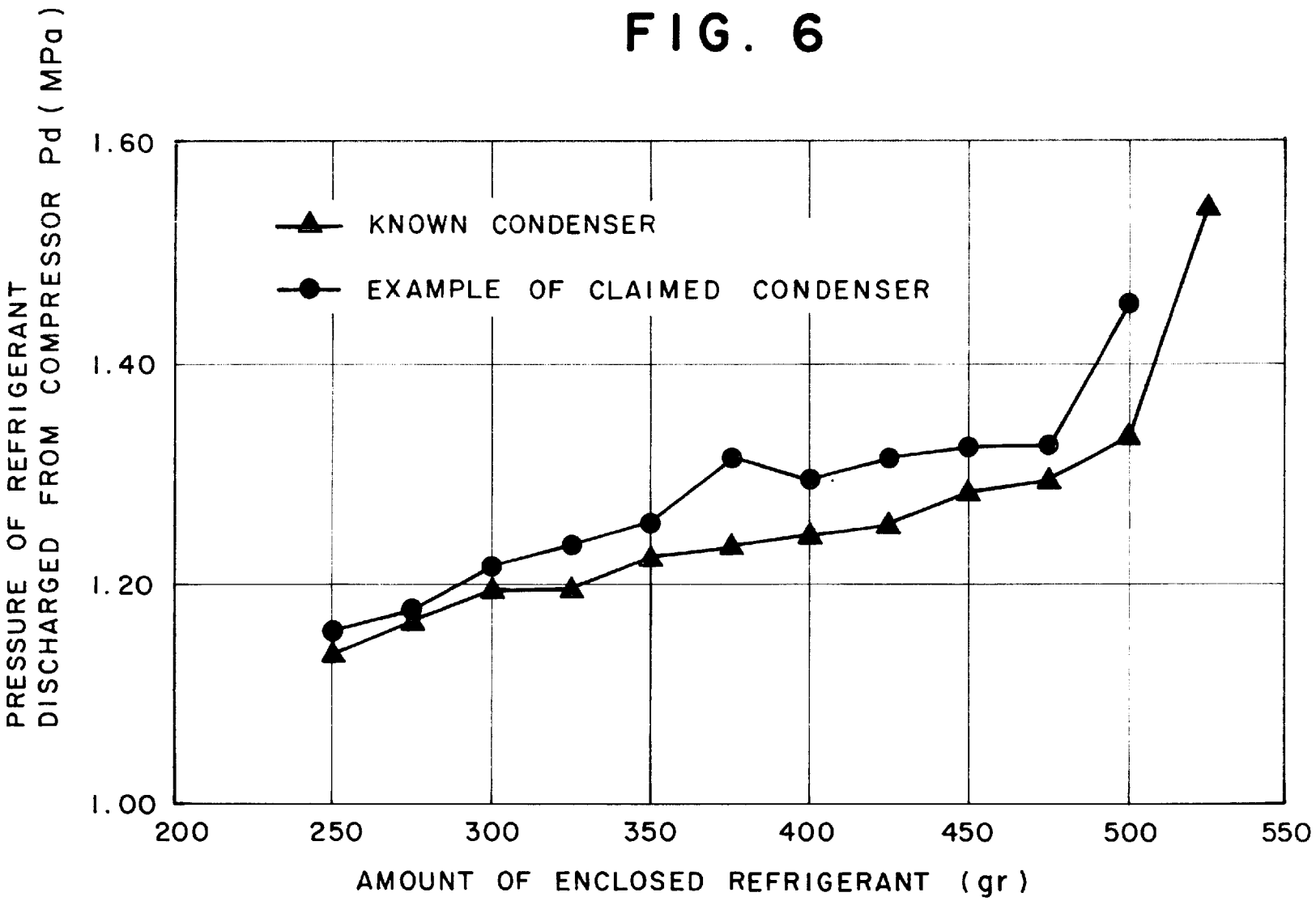
FIG. 6 is a graph showing a relationship between the amount of enclosed refrigerant and the pressure of discharged refrigerant from a compressor in the comparison experiment.
Figure 7:
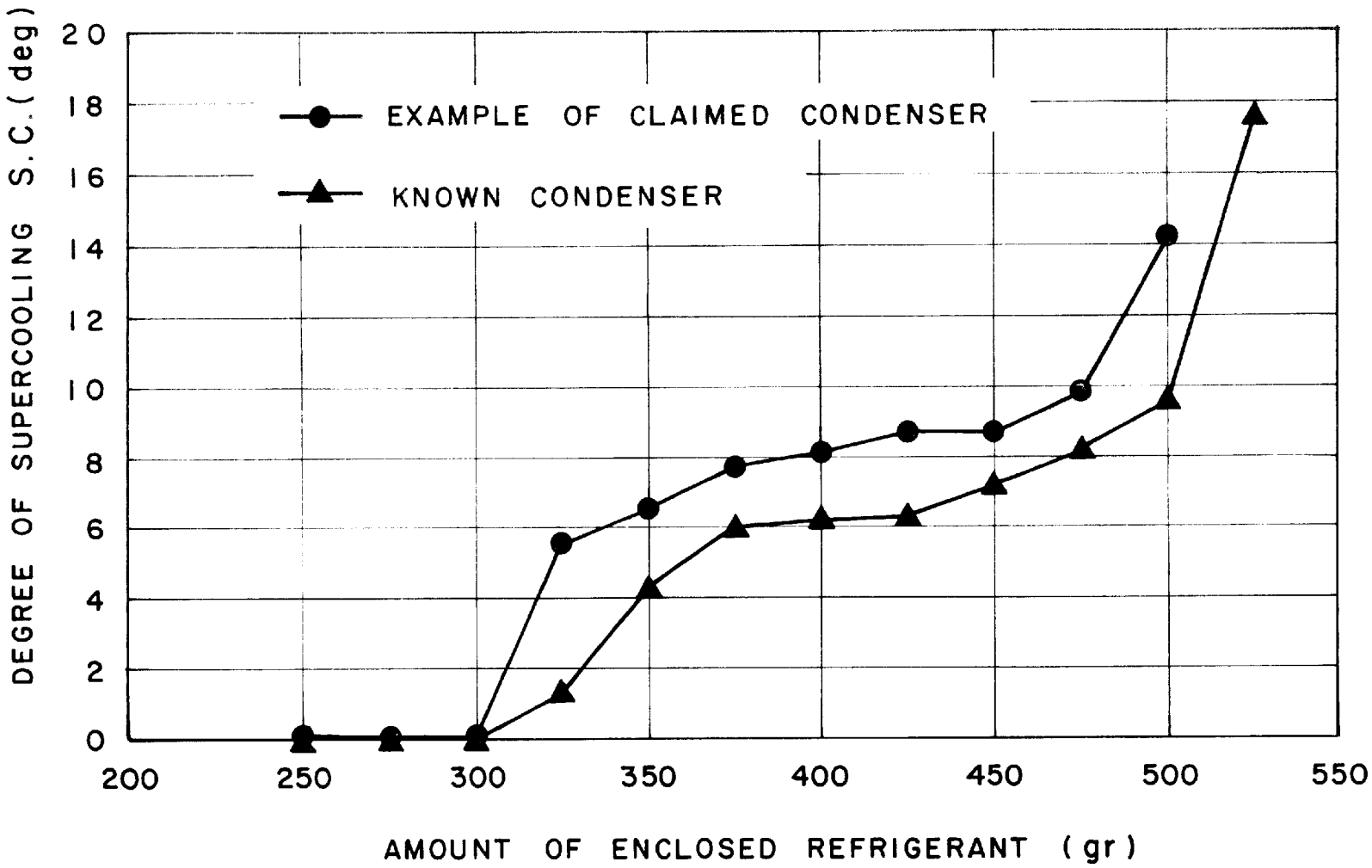
FIG. 7 is a graph showing a relationship between the amount of enclosed refrigerant and the degree of supercooling in the comparison experiment.

The result of the experiment is shown in FIGS. 6 and 7. The data indicated by "Example of Claimed Condenser" shows data of subcooling-type condenser 1 according to the present invention, and the data indicated by "Known Condenser" shows data of subcooling-type condenser 31 according to known technology.

FIG. 6 shows a relationship between an amount of enclosed refrigerant (gr) and a pressure of discharged refrigerant from a compressor Pd (MPa) in a refrigerating cycle, such as that depicted in FIG. 4. As understood from FIG. 6, in subcooling-type condenser 1 according to the present invention, the compressor discharge refrigerant pressure is adequately increased, and a desired compression is performed even when only a small amount of refrigerant is enclosed.

FIG. 7 shows a relationship between an amount of refrigerant enclosed in the cooling cycle including the subcooling-type condenser and a degree of supercooling (° C.) in the portion of subcooling core 10 of the condenser. As understood from FIG. 7, in subcooling-type condenser 1, as depicted in FIG. 1 according to the present invention, when the amount of enclosed refrigerant exceeds more than a certain level, the degree of supercooling gradually increases along a certain curve, and after the increase in the degree of supercooling, a plateau region is formed, wherein the degree of supercooling is about constant and maintained in a stable condition even if the amount of enclosed refrigerant increases. When the amount of enclosed refrigerant exceeds the amount found in the plateau region, the degree of supercooling increases again. This degree of supercooling indicates an efficient supercooling operation, that is, a superior re-liquefaction function, at a condition, for example, more than 5. As shown in FIG. 7, in subcooling-type condenser 1 depicted in FIG. 1, the plateau region may be formed as a broad and stable region, as compared with that of known subcooling-type condenser 31, and besides, an excellent properties of degree of supercooling may be obtained by a reduced amount of enclosed refrigerant. In particular, a desired re-liquefaction function may be obtained by a reduced amount of enclosed refrigerant.

Thus, as understood from FIGS. 6 and 7, in subcooling-type condenser 1 according to the present invention, superior properties may be obtained as compared with subcooling-type condenser 31 according to the known technology. Besides, in subcooling-type condenser 1, because it is not necessary to provide a separate liquid tank 38 and a desired liquid tank function is given to header 3 itself, the structure is simplified, and the entire condenser 1 may be reduced in size and manufacturing cost.

Figure 8:
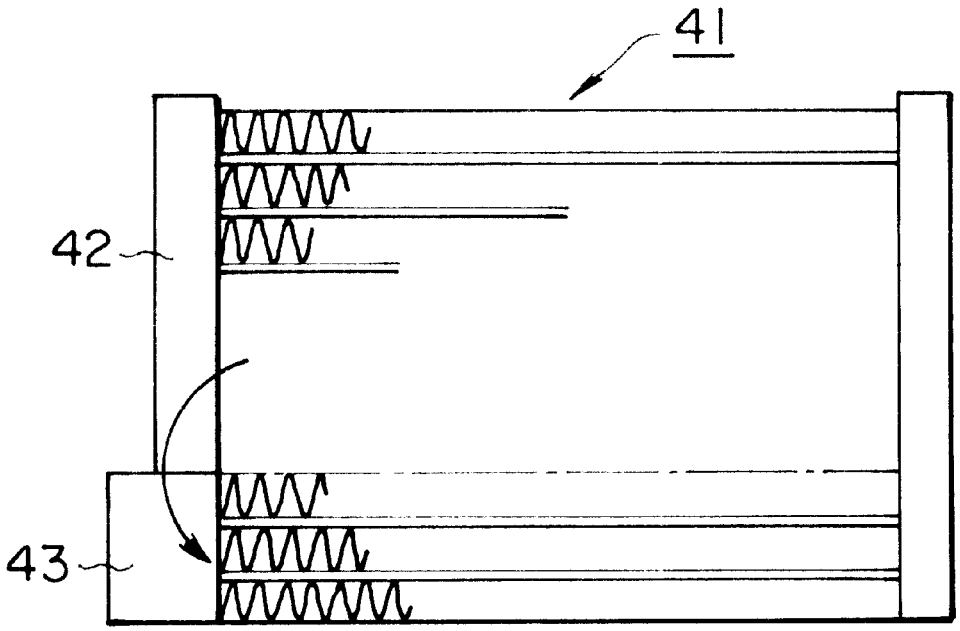
FIG. 8 is a schematic elevational view of a subcooling-type condenser according to another embodiment of the present invention.
Figure 9:
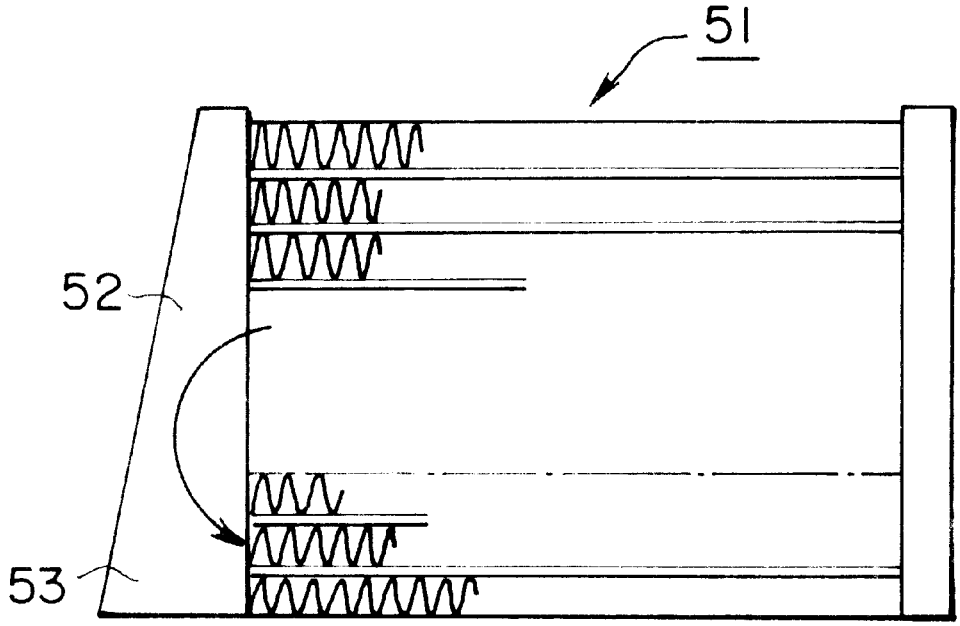
FIG. 9 is a schematic elevational view of a subcooling-type condenser according to a further embodiment of the present invention.

Although liquid refrigerant storage portion 11 is formed in the lower portion of second header 3 and having a relatively large diameter in the above-described embodiment, another method for forming a liquid refrigerant storage portion may be employed. For example, as depicted in FIG. 8, only a lower portion of second header 42 may be formed as a large diameter portion, and a liquid refrigerant storage portion 43 may be formed in that large diameter portion to form a subcooling-type condenser 41. Alternatively, as depicted in FIG. 9, second header 52 may be formed as a tapered header having a greater cross-sectional area at lower positions, and a liquid refrigerant storage portion 53 may be formed in the lower header portion to form a subcooling-type condenser 51.

Further, in the above-described embodiment, although refrigerant condensation core 9 is formed as a one-way path, the refrigerant path also may be formed as a two-way path, that is, a path structure that returns from whence it came or on having at least two joined paths. In any case, however, a refrigerant condensation core and a subcooling core are clearly divided, for example, by providing a partition in a header, or, by forming a header portion of a first header corresponding to an entrance portion of a refrigerant condensation core and a header portion corresponding to an exit portion of a subcooling core by separate parts. In particular, in the present invention, because neither a header of an entrance portion of a subcooling core nor a header of an exit portion of a refrigerant condensation core has a partition (in the case of one-way path), or, because, even if a partition is provided, it is provided only at a middle portion of the header of the exit portion of a refrigerant condensation core; the entire portion of the header of the exit portion of the refrigerant condensation core, or, a lower half portion of the header of the exit portion of the refrigerant condensation core, may be used as a liquid refrigerant storage portion. Therefore, a separate member is not required to form a liquid refrigerant storage portion, and a header having an excessively large capacity is not required. Consequently, the size of the entire condenser may be reduced, and an optimum subcooling-type condenser may be provided.

In addition, the capacity of the second header in the subcooling-type condenser according to the present invention is explained below. The capacity of the second header Vh is set within the range of 100 cc≦Vh≦250 cc, and preferably, within the range of 150 cc<Vh≦200 cc.

For investigation of an optimum range of the capacity of the second header Vh, with respect to subcooling-type condenser 1 as depicted in FIG. 1 having second headers with various inner diameters; an experiment was performed in which the capacity at various values was changed. By this experiment, the relationship between the plateau regions (as defined by an amount of enclosed refrigerant (gr)) and the capacity of the second header was determined. The results are shown in FIG. 10.

Figure 10:
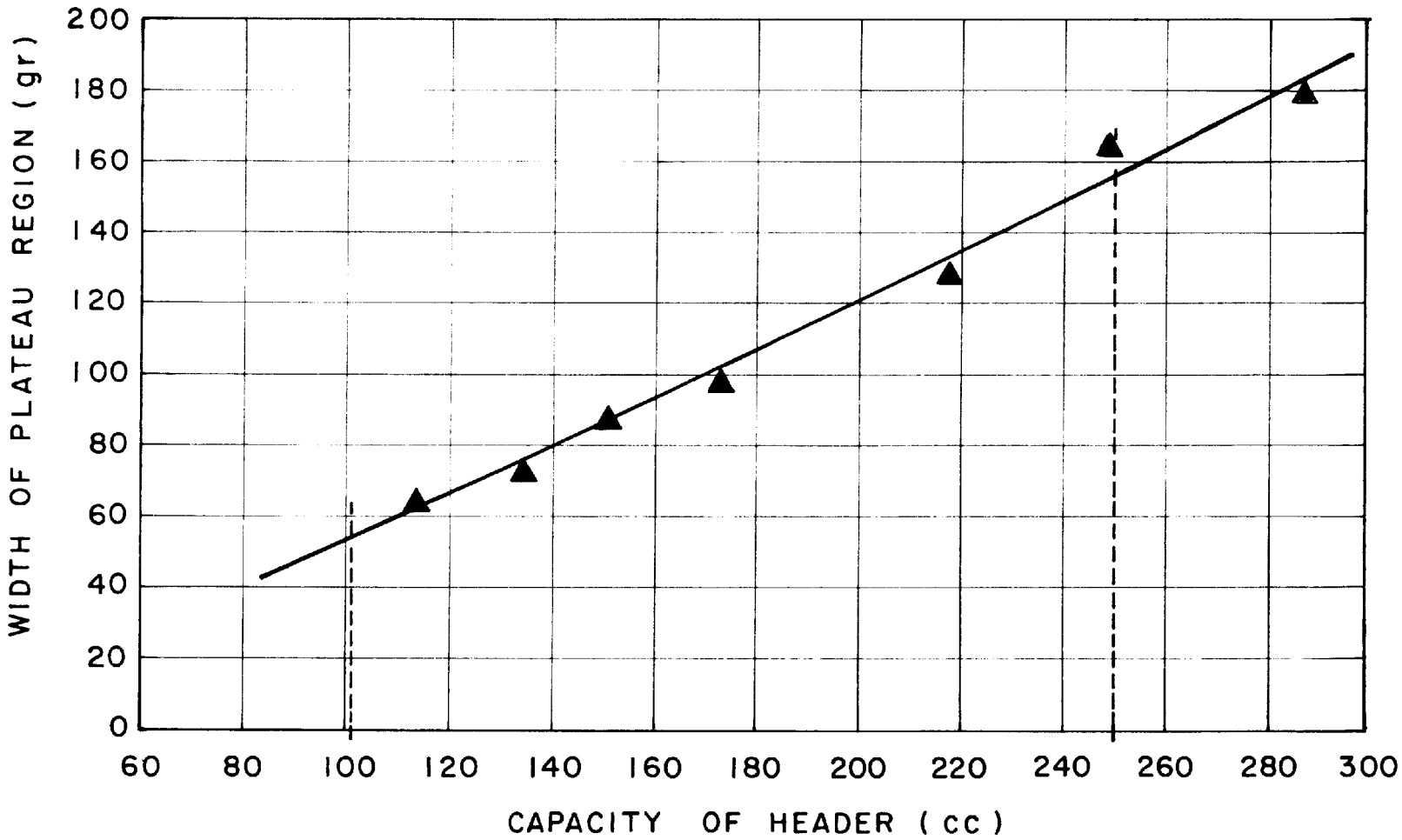
FIG. 10 is a graph showing a relationship between a capacity of a second header and a width of a plateau region.

In FIG. 10, in order to obtain a property of a subcooling-type condenser targeted in the present invention, the plateau region has a lower limit of greater than 50 gr and an upper limit of less than 150 gr. The reason for determining the lower limit at 50 gr is that at least 50 gr is required as an amount of variation corresponding to the variation due to cooling operation condition (i.e., the variation due to cooling load and the variation due to an amount of refrigerant circulating within a refrigerating cycle). If the plateau region begins at less than 50 gr, there may be insufficient enclosed refrigerant for cooling ability to be ensured, and the cycle may not function effectively as a cooling apparatus. On the other hand, the reason for deciding the upper limit at 150 gr is because the life of a cooling apparatus is usually more than ten years, during which time an amount of refrigerant may leak and an error in the amount of initially enclosed refrigerant may result, 150 gr provides sufficient width of the plateau region. Further, because, even if the width of the plateau region is greater than 150 gr, the cooling ability may not increase greatly. On the contrary, the capacity of the header may become too great, and therefore, the condenser may not achieve the requirement for reducing the size of the entire condenser. This range of 50 gr to 150 gr for the width of the plateau region required does not vary much depending upon the size of the apparatus in a cooling system. For example, in cooling system applied to an air conditioner for vehicles, and as long as the width of the plateau region is set within a range of 50 to 150 gr, it is enough. However, these values represent a lower limit and an upper limit, with a still more preferable range of 90 gr to 120 gr.

The range of the capacity of the second header Vh corresponding to the above-described range of the width of the plateau region of 50 to 150 gr is determined as follows from FIG. 10: 100 cc≦Vh≦250 cc.

The range of the capacity of the second header Vh corresponding to the preferable range of the width of the plateau region of 90 to 120 gr is determined as follows from FIG. 10: 150 cc≦Vh≦200 cc. These ranges are determined as optimum ranges in the present invention.

Figure 11:
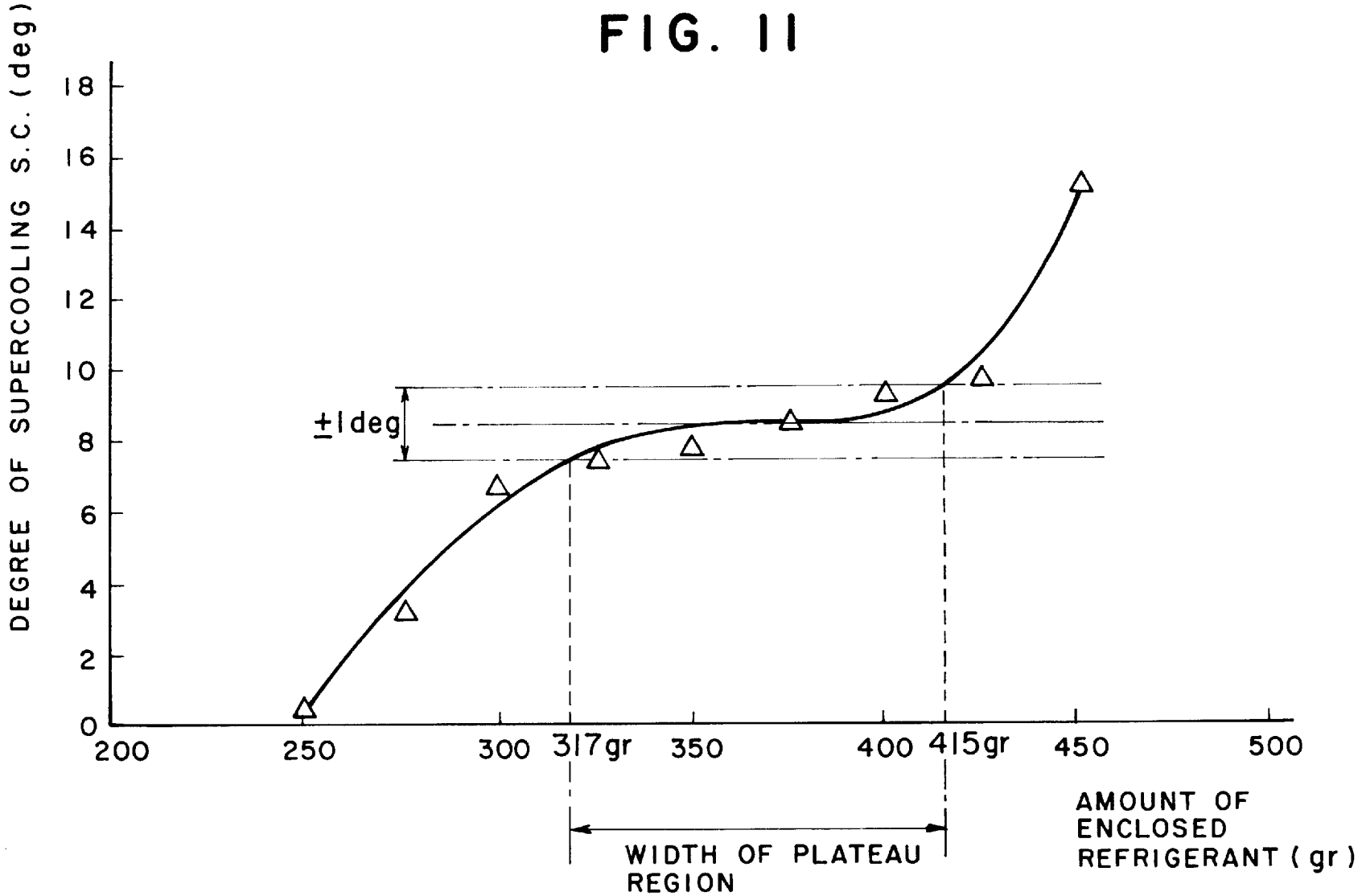
FIG. 11 is a graph showing a relationship between the amount of enclosed refrigerant and the degree of supercooling in an experiment using a subcooling-type condenser, as graphed in FIG. 10.

In a subcooling-type condenser as shown in FIG. 10, and having a capacity Vh of 172 cc of the second header, the relationship between the amount of enclosed refrigerant (gr) and the degree of supercooling is shown in FIG. 11. As shown in FIG. 11, when the condition for forming a plateau region is defined as a condition in which the degree of supercooling is within ±1° C. a plateau region having a width of about 100 gr may be formed. It is recognized that this width falls within the above-described preferred range of the widths of the plateau region (i.e., 90 gr–120 gr).

Thus, in the present invention, by setting the capacity of the second header Vh within an optimum range, an optimum width of the plateau region may be achieved, and the subcooling-type condenser may be reduced in size, and a stable desired cooling operation may be achieved.

Although several embodiments of the present invention have been described in detail herein, the scope of the invention is not limited thereto. It will be appreciated by those skilled in the art that various modifications may be made without departing from the scope of the invention. Accordingly, the embodiments disclosed herein are only exemplary. It is to be understood that the scope of the invention is not to be limited thereby, but is to be determined by the claims which follow.

What is claimed is:

1. A subcooling-type condenser comprising a pair of headers, and a plurality of heat transfer tubes interconnecting said pair of headers and extending in parallel to each other, said condenser being divided into a refrigerant condensation core for condensing refrigerant and a subcooling core for supercooling refrigerant condensed by said refrigerant condensation core, wherein a second header forming a header portion corresponding to an entrance portion of said subcooling core is formed integrally with a header portion for said refrigerant condensation core and a header portion for said subcooling core, at least said header portion corresponding to said entrance portion of said subcooling core is formed as a liquid refrigerant storage portion, and a capacity of said second header Vh is set within a range of 100 cc≦Vh≦250 cc.

2. The subcooling-type condenser of claim 1, wherein said capacity of said second header Vh is set within a range of 150 cc≦Vh≦200 cc.

3. The subcooling-type condenser of claim 1, wherein a capacity of at least said header portion corresponding to said entrance portion of said subcooling core in said second header is greater than a capacity of a header portion corresponding to an exit portion of said subcooling core in a first header.

4. The subcooling-type condenser of claim 3, wherein said capacity of at least said header portion corresponding to said entrance portion of said subcooling core in said second header is in a range of about two times to about three times of said capacity of said header portion corresponding to said exit portion of said subcooling core in said first header.

5. The subcooling-type condenser of claim 1, wherein said second header is formed, so that the cross-sectional area of said header portion for said refrigerant condensation core is substantially identical to the cross-sectional area of said header portion for said subcooling core.

6. The subcooling-type condenser of claim 1, wherein a first header is formed integrally with a header portion for said refrigerant condensation core and a header portion for said subcooling core, and said refrigerant condensation core and said subcooling core divide said first header.

7. The subcooling-type condenser of claim 6, wherein said refrigerant condensation core and said subcooling core are separated by providing a partition in said first header.

8. The subcooling-type condenser of claim 1, wherein a refrigerant passage formed by said plurality of heat transfer tubes in said refrigerant condensation core is a one-way path.

9. The subcooling-type condenser of claim 1, wherein said pair of headers extend in a vertical direction, and said plurality of heat transfer tubes extend in a horizontal direction.

* * * * *

UNITED STATES PATENT AND TRADEMARK OFFICE

CERTIFICATE OF CORRECTION

PATENT NO. : 6,470,703 B2
DATED : October 1, 2002
INVENTOR(S) : Kenichi Wada et al.

It is certified that error appears in the above-identified patent and that said Letters Patent is hereby corrected as shown below:

Title page,
Item [56], U.S. PATENT DOCUMENTS, delete "2,086,835" and insert -- 5,086,835 --.

Signed and Sealed this

Twenty-fifth Day of March, 2003

JAMES E. ROGAN
*Director of the United States Patent and Trademark Office*